US011292666B2

(12) United States Patent
Liao et al.

(10) Patent No.: US 11,292,666 B2
(45) Date of Patent: Apr. 5, 2022

(54) COVER TURNING MECHANISM AND GARBAGE CAN THEREOF

(71) Applicant: Jiangmen Jinlong High Technology Industrial Co., Ltd., Guangdong (CN)

(72) Inventors: Jinsheng Liao, Guangdong (CN); Weitang Lu, Guangdong (CN)

(73) Assignee: Jiangmen Jinlong High Technology Industrial Co., Ltd., Guangdong (CN)

( * ) Notice: Subject to any disclaimer, the term of this patent is extended or adjusted under 35 U.S.C. 154(b) by 38 days.

(21) Appl. No.: 16/902,462

(22) Filed: Jun. 16, 2020

(65) Prior Publication Data

US 2021/0362946 A1 Nov. 25, 2021

(30) Foreign Application Priority Data

May 19, 2020 (CN) ..... 202010422989.0

(51) Int. Cl.
*B65F 1/16* (2006.01)

(52) U.S. Cl.
CPC ..... *B65F 1/1638* (2013.01)

(58) Field of Classification Search
CPC ..... B65F 1/1638; B65F 1/1623; B65D 2590/664; B65D 43/26
USPC ..... 220/829, 211
See application file for complete search history.

(56) References Cited

U.S. PATENT DOCUMENTS

| | | | | |
|---|---|---|---|---|
| 6,264,829 | B1 * | 7/2001 | Antalffy | C10B 25/10 196/46 |
| 7,781,995 | B2 * | 8/2010 | Yang | B65F 1/08 318/266 |
| 2002/0066261 | A1 * | 6/2002 | Richards | B65F 1/163 53/574 |
| 2005/0258794 | A1 * | 11/2005 | Fukuizumi | B64D 11/02 318/480 |
| 2010/0308045 | A1 * | 12/2010 | Tong | B65F 1/08 220/211 |
| 2017/0320639 | A1 * | 11/2017 | Shek | B65D 43/26 |
| 2018/0110893 | A1 * | 4/2018 | Chang | B65F 1/1638 |
| 2018/0229931 | A1 * | 8/2018 | Shek | B65F 1/1638 |
| 2019/0270586 | A1 * | 9/2019 | Lovingood | B65F 1/1638 |

* cited by examiner

*Primary Examiner* — J. Gregory Pickett
*Assistant Examiner* — Niki M Eloshway
(74) *Attorney, Agent, or Firm* — Chernoff, Vilhauer, McClung & Stenzel, LLP

(57) ABSTRACT

Disclosed is a garbage can including a cover turning mechanism, the cover turning mechanism includes a housing, a cover, a first connecting rod and a second connecting rod. Wherein the housing is installed with a motor and a rotating rod is rotatably connected to the housing; the cover covers the housing and the cover is fixedly connected with the rotating rod; the first connecting rod is fixedly connected with the motor; one end of the second connecting rod is rotatably connected to the first connecting rod, and other end of the second connecting rod is rotatably connected to the cover; a torsional spring is arranged on the rotating rod, the torsional spring bears against an inner wall of the housing.

16 Claims, 3 Drawing Sheets

COVER TURNING MECHANISM AND GARBAGE CAN THEREOF

TECHNICAL FIELD

The present disclosure relates to the field of articles of daily use, in particular to a cover turning mechanism and a garbage can thereof.

BACKGROUND

An induction garbage can is controlled by a circuit chip and is composed of infrared detection device and mechatronic drive system. The cover will automatically open as long as the object is close to the induction area, and the cover will automatically close after the object or hand leaves the induction area for a few seconds. The cover is powered by the battery without connecting to an external power supply, and the power consumed by the cover is low. With a streamlined inductive cover which is composed of infrared detection device and microcomputer, it is flexible and convenient for the user to operate the garbage can and throw out the garbage without manual or foot steps required. However, the existing induction garbage can is generally driven by a DC motor, some existing designs achieve precise position control by using a stepping motor. When the stepping motor drives the cover to turn, the stuck, shaking and other unstable situations which influence the use experience will occur easily.

SUMMARY

The present disclosure intends to address at least one of the technical problems existing in the prior art. Therefore, the present disclosure provides a cover turning mechanism which can make the cover turn smoothly.

The present disclosure also provides a garbage can with the above cover turning mechanism.

A cover turning mechanism in accordance with the first aspect of the embodiments of the present disclosure, including:

a housing provided with a motor, and a rotating rod rotatably connected to the housing;

a cover covering on the housing, and the cover is fixedly connected with the rotating rod;

a first connecting rod fixedly connected to the motor;

a second connecting rod, one end of the second connecting rod is rotatably connected to first connecting rod, and other end is rotatably connected to the cover;

wherein a torsional spring is arranged on the rotating rod, the torsional spring bears against an inner wall of the housing.

The cover turning mechanism in accordance with the embodiments of the present disclosure has the following beneficial effect: the motor drives the first connecting rod to rotate so that the second connecting rod is driven to swing, and then the second connecting rod drives the cover to rotate around the axis of the rotating rod thereby the cover is opened or closed. In the process of opening or closing the cover, the torsional spring bears against an inner wall of the housing and provides a supporting torque, while eliminating the gap forming when the first connecting rod act on the second connecting rod. The forces at multiple nodes are in relatively balanced state which makes it easy and accurate for the motor to control the angle, and makes the whole process of opening or closing the cover more smoothly.

In some embodiments of the present disclosure, the housing is provided with an installation seat, and the installation seat is provided with a first concave hole. The first connecting rod is provided with a first convex, and the first convex is embedded into the first concave hole and rotates in the first concave hole. The first convex is in clearance fit with the first concave hole. The clearance fit avoids a hindrance caused by the mounting seat to the first connecting rod when the first connecting rod is driven to swing, and makes the first connecting rod swing more smoothly.

In some embodiments of the present disclosure, a first rotating shaft is provided at one end of the second connecting rod, the first connecting rod is provided with a first perforation, the first rotating shaft is inserted in the first perforation, and the first rotating shaft is in interference fit with the first perforation. The gap between the first rotating shaft and the first perforation is reduced, such that in the process of the first connecting rod driving the second connecting rod to swing, it will avoid the gap causing the structural instability between the first connecting rod and the second connecting rod, and improve the stability when the cover is turning.

In some embodiments of the present disclosure, a second perforation is provided at a bottom of the cover, the rotating rod is inserted into the second perforation, and the rotating rod is in interference fit with the second perforation. The rotating rod is inserted in the second perforation via the interference fit. When the second connecting rod drives the cover to turn, the rotating rod rotates in the housing, and the interference fit causes the rotating rod to drive the torsional spring to rotate and causes the torsional spring to be in contact with the inner wall of the housing. The stability of the cover is improved during rotation and the stuck situation is prevented.

In some embodiments of the present disclosure, a second rotating shaft is provided at one end of the second connecting rod. A second concave hole is arranged on the cover, the second rotating shaft is inserted into the second concave hole and rotates relative to the second concave hole, and the second rotating shaft is in clearance fit with the second concave hole.

In some embodiments of the present disclosure, a clamping block is arranged on the inner wall of the housing and a clamping slot is formed between a lower part of the clamping block and the inner wall of the housing. A hook is arranged at an end of the torsional spring which bears against the inner wall of the housing. The hook is clamped into the clamping slot so that the torsional spring can be clamped with the clamping block. In the closing process of the cover, the rotating rod rotates and the torsional spring is reset. In the process of reset, the hook is inserted into the clamping slot, and the hook is connected with the clamping block to position the torsional spring.

In some embodiments of the present disclosure, the housing is provided with a platform which bears against the first connecting rod so that the first connecting rod stops swinging. The first connecting rod swings by the driving of motor, the cover turns up through the second connecting rod. In the process of turning up, the first connecting rod is in contact with a edge of the platform balance, such that the first connecting rod cannot continue to swing, thereby the turning angle of the cover is limited to prevent the cover from turning excessively. At the same time, it will prevent the first connecting rod and the second connecting rod from reversing and ensure the normal movement of the structure.

A garbage can in accordance with the second aspect of the embodiments of the present disclosure, the garbage can includes anyone cover turning mechanism as mentioned above.

The garbage can in accordance with the embodiments of the present disclosure has the following beneficial effect: the motor drives the first connecting rod to rotate so that the second connecting rod is driven to swing, and then the second connecting rod drives the cover to rotate around the axis of the rotating rod thereby the cover is opened. In the process of opening or closing the cover, the torsional spring bears against the inner wall of the housing and provides a supporting torque, thereby the whole process of opening or closing the cover is more smoothly.

Additional aspects and advantages of the present disclosure will be described in the following description, which will become apparent from the description below or be known through the practice of the present disclosure.

BRIEF DESCRIPTION OF THE DRAWINGS

The above and/or additional aspects and advantages of the present disclosure will become apparent and easy to understand from the description of the embodiments in conjunction with the drawings, wherein.

REFERENCE NUMBERS

Figure 1:
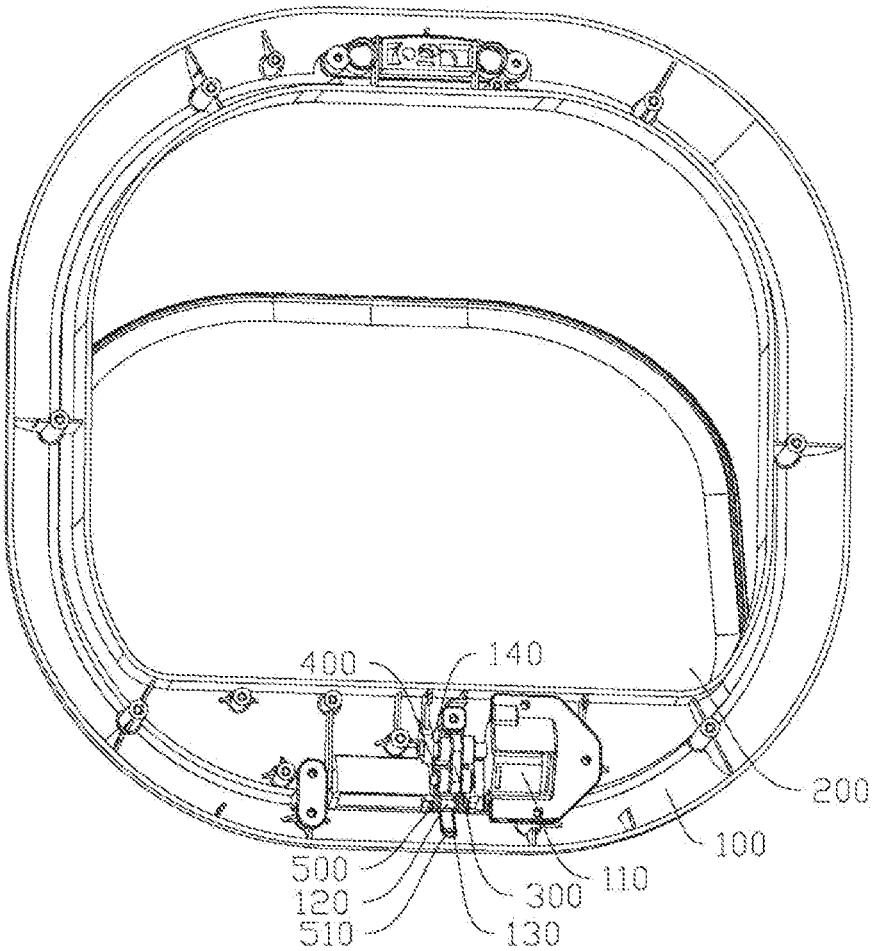
FIG. 1 is an installation structure diagram of the cover turning mechanism of the embodiment of the present disclosure.

100—housing, 110—motor, 120—rotating rod, 130—clamping block, 140—installation seat;
200—cover;
300—first connecting rod;
400—second connecting rod;
500—torsional spring, 510—hook

DETAILED DESCRIPTION OF THE EMBODIMENTS

Embodiments of the present disclosure are described in detail below, examples of which are shown in the drawings. The identical or similar reference numbers indicate identical or similar elements or the elements having the same or similar function. The following embodiments described in conjunction with the drawings are exemplary and are only used to explain the present disclosure and can not be understood as a limitation to the present disclosure.

In the description of the present disclosure, it should be understood that, terms such as "upper", "lower", "front", "rear", "left", "right" should be construed to refer to the orientation as then described or as shown in the drawings under discussion. These relative terms are for convenience of description and do not require that the present disclosure be constructed or operated in a particular orientation, therefore cannot be construed to limit the present disclosure.

In the description of the present disclosure, the meanings of "several" are "one or more", and the meanings of "multiple" is "more than two", and "greater than, less than, more than" shall be understood as excluding the number itself, the meanings of "above, below and within" shall be understood as including the number itself. Terms such as "first" and "second" are used herein for purposes of description and are not intended to indicate or imply relative importance or significance or to imply the number of indicated technical features or indicate the sequence of technical features.

In the present disclosure, unless specified or limited otherwise, the terms "mounted", "connected", "coupled", "fixed" and the like are used broadly. The specific meaning of the above terms within the present disclosure may be understood by those skilled in the art according to particular circumstances.

A garbage can in a specific embodiment of the present disclosure, includes a cover turning mechanism. Referring to FIG. 1, the cover turning mechanism includes a housing 100, a cover 200, a first connecting rod 300 and a second connecting rod 400. Wherein the housing 100 is installed with a motor 110 and a rotating rod 120 is rotatably connected to the housing 100; the cover 200 covers on the housing 100 and the cover 200 is fixedly connected with the rotating rod 120; the first connecting rod 300 is fixedly connected with the motor 110; one end of the second connecting rod 400 is rotatably connected to the first connecting rod 300, and the other end of the second connecting rod 400 is rotatably connected to the cover 200; a torsional spring 500 is arranged on the rotating rod 120, the torsional spring 500 bears against the inner wall of the housing 100.

Figure 2:
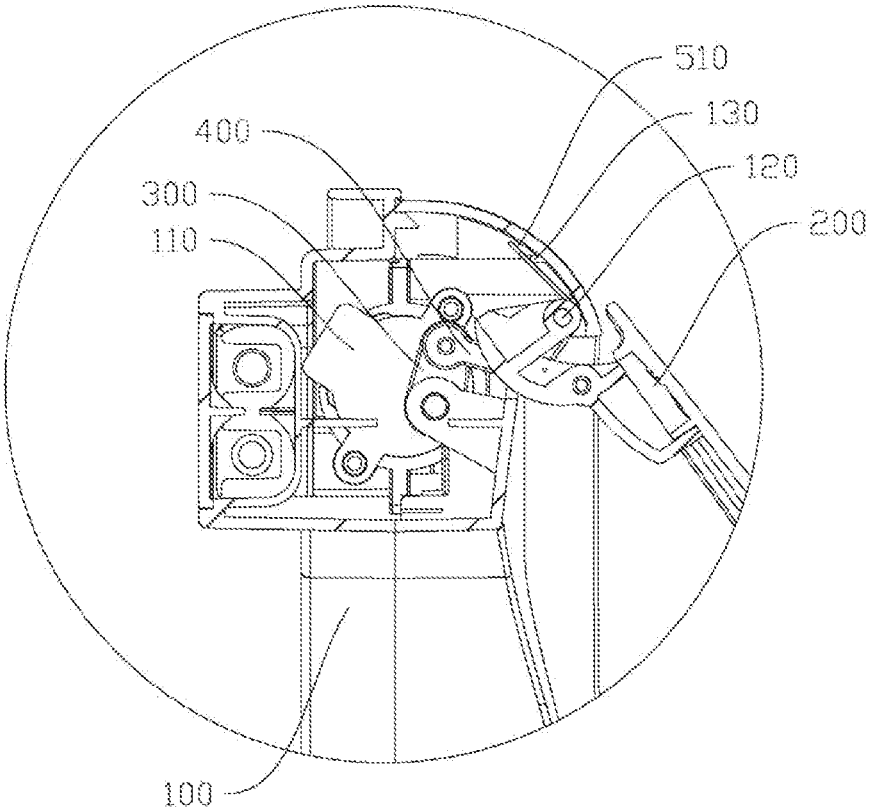
FIG. 2 is an inner structure diagram of the cover turning mechanism of the embodiment of the present disclosure.

In use, with reference to FIG. 2, the motor 110 is activated and drives the first connecting rod 300 to rotate upward, and then the first connecting rod 300 drives the second connecting rod 400 to swing, so that the second connecting rod 400 drives the cover 200 to rotate around the axis of the rotating rod 120 and the cover 200 is opened. In the process of opening the cover 200, the torsional spring 500 bears against the inner wall of the housing 100 and provides a supporting torque, while eliminating the gap between the first connecting rod 300 and the second connecting rod 400. The forces at multiple nodes are in relatively balanced state which makes it easy and accurate for the motor 110 to control the angle, and makes the whole process of opening or closing the cover 200 more smoothly. In addition, the motor 110 reverses driving the first connecting rod 300 to turn down, so that the second connecting rod 400 swings and releases the support to the cover 200, and then the cover 200 is closed.

In some embodiments, in order to improve the fluency during the process of closing the cover 200, a clamping block 130 is arranged on the inner wall of the housing and a clamping slot is formed between a lower part of the clamping block 130 and the inner wall of the housing 100. A hook 510 is arranged at an end of the torsional spring 500 which bears against the inner wall of the housing 100. The hook 510 is clamped into the clamping slot so that the torsional spring 500 can be clamped with the clamping block 130. In the process of closing the cover 200, the rotating rod 120 rotates and the torsional spring 500 is reset. In the process of reset, the hook 510 is inserted into the clamping slot, and the hook 510 is connected with the clamping block 130, which causes the torsional spring 500 to generate a buffer force on the cover 200 and causes the cover 200 to be closed more smoothly. In addition, the hook 510 can also position the torsional spring 500.

In some embodiments of the present disclosure, the housing 100 is provided with an installation seat 140, and the installation seat 140 is provided with a first concave hole. The first connecting rod 300 is provided with a first convex, and the first convex is embedded into the first concave hole and rotates in the first concave hole. The first convex is in clearance fit with the first concave hole. The clearance fit avoids a hindrance caused by the mounting seat 140 to the first connecting rod 300 when the first connecting rod 300 is driven to swing, and makes the first connecting rod 300 swing more smoothly. In other embodiments, the first convex is arranged on the mounting seat 140, while the first connecting rod 300 is provided with a first concave hole.

In some embodiments of the present disclosure, one end of the second connecting rod 400 is provided with a first rotating shaft, the first connecting rod 300 is provided with a first perforation, the first rotating shaft is inserted in the first perforation, and the first rotating shaft is in interference fit with the first perforation. The gap between the first rotating shaft and the first perforation is reduced, such that in the process of the first connecting rod 300 driving the second connecting rod 400 to swing, it will avoid the gap causing the structural instability between the first connecting rod 300 and the second connecting rod 400, and improve the stability when the cover 200 is turning. In other embodiments, the first rotating shaft is arranged on the first connecting rod 300 and the first perforation is arranged on the second connecting rod 400.

In some embodiments of the present disclosure, a second perforation is provided at a bottom of the cover 200, the rotating rod 120 is inserted into the second perforation, and the rotating rod 120 is in interference fit with the second perforation. The rotating rod 120 is inserted in the second perforation via the interference fit. When the second connecting rod 400 drives the cover 200 to turn, the rotating rod 120 rotates in the housing 100, and the interference fit causes the rotating rod 120 to drive the torsional spring 500 to rotate and causes the torsional spring 500 to be in contact with the inner wall of the housing 100. The stability of the cover 200 is improved during rotation and the stuck situation is prevented.

In some embodiments of the present disclosure, one end of the second connecting rod 400 is provided with a second rotating shaft, a second concave hole is arranged on the cover 200, the second rotating shaft is inserted into the second concave hole and rotates relative to the second concave hole, and the second rotating shaft is in clearance fit with the second concave hole. In other embodiments, the circumference of is arranged on the cover 200, while the second rotating shaft is arranged on the second connecting rod 400.

Figure 3:
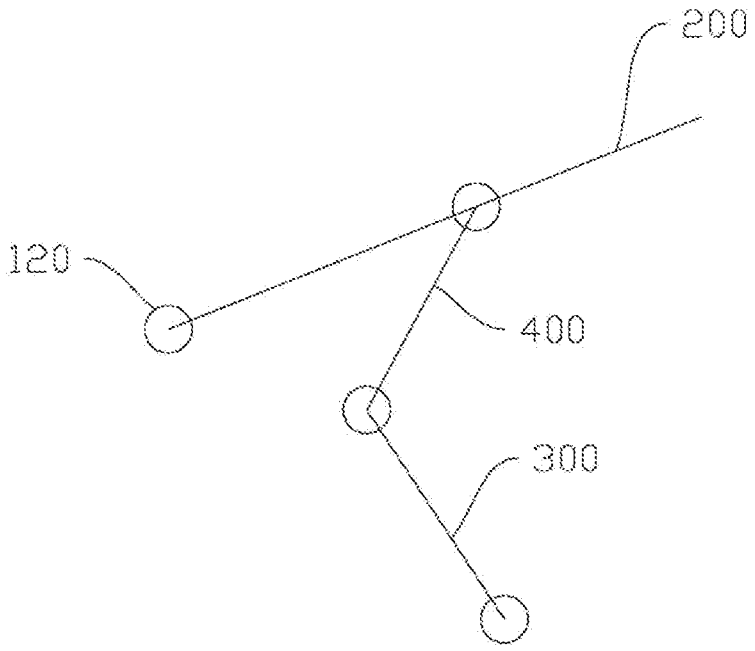
FIG. 3 is a simplified structure diagram of the cover turning mechanism of the embodiment of the present disclosure.

In some embodiments of the present disclosure, the housing 100 is provided with a platform which is in contact with the first connecting rod 300 so that the first connecting rod 300 stops swinging. The first connecting rod 300 swings by the driving of motor 110, the cover 200 turns up through the second connecting rod 400. In the process of turning up, the first connecting rod 300 is in contact with a edge of the platform balance, such that the first connecting rod 300 cannot continue to swing, thereby the turning angle of the cover 200 is limited to prevent the cover 200 from turning excessively. With reference to FIG. 3, when the swing path of the first connecting rod 300 is blocked, the first connecting rod 300 stops swinging, and the second connecting rod 400 also stops swinging and begins to support the cover 200, such that avoiding the first connecting rod 300 and the second connecting rod 400 swinging to a dead point or avoiding a reversal that causes the cover 200 to not work properly.

In a specific embodiment of the present disclosure, the garbage can includes a cover turning mechanism, the cover turning mechanism includes a housing 100, a cover 200, a first connecting rod 300 and a second connecting rod 400. Wherein the housing 100 is installed with a motor 110 and is a rotating rod 120 is rotatably connected to the housing 100; the cover 200 covers on the housing 100 and the cover 200 is fixedly connected with the rotating rod 120; the first connecting rod 300 is fixedly connected with the motor 110; one end of the second connecting rod 400 is rotatably connected to the first connecting rod 300, and the other end of the second connecting rod 400 is rotatably connected to the cover 200; a torsional spring 500 is arranged on the rotating rod 120, the torsional spring 500 bears against the inner wall of the housing 100. A clamping block 130 is arranged on the inner wall of the housing and a clamping slot is formed between a lower part of the clamping block 130 and the inner wall of the housing 100. A hook 510 is arranged at an end of the torsional spring 500 which bears against the inner wall of the housing 100. The hook 510 is clamped into the clamping slot so that the torsional spring 500 can be clamped with the clamping block 130. The housing 100 is provided with an installation seat 140, and the installation seat 140 is provided with a first concave hole. The first connecting rod 300 is provided with a first convex, and the first convex is embedded into the first concave hole and rotates in the first concave hole. The first convex is in clearance fit with the first concave hole. One end of the second connecting rod 400 is provided with a first rotating shaft, the second connecting rod 400 is provided with a first perforation, the first rotating shaft is inserted in the first perforation, and the first rotating shaft is in interference fit with the first perforation. A second perforation is provided at the bottom of the cover 200, the rotating rod 120 is inserted into the second perforation, and the rotating rod 120 is in interference fit with the second perforation. One end of the second connecting rod 400 is provided with a second rotating shaft, a second concave hole is arranged on the cover 200, the second rotating shaft is inserted into the second concave hole and rotates relative to the second concave hole, and the second rotating shaft is in clearance fit with the second concave hole. The housing 100 is provided with a platform which is in contact with the first connecting rod 300 so that the first connecting rod 300 stops swinging.

Although explanatory embodiments have been shown and described, it would be appreciated that the above embodiments are exemplary and cannot be construed to limit the present disclosure, and changes, amendments, alternatives and modifications may be made by those skilled in the art within the scope of the present disclosure.

What is claimed is:

1. A cover turning mechanism, comprising:

a housing;

a motor arranged on the housing;

a rotating rod rotatably connected to the housing;

a cover covering the housing, and fixedly connected with the rotating rod;

a first connecting rod fixedly connected to the motor; and a second connecting rod, one end of the second connecting rod is rotatably connected to the rotating rod, and other end of the second connecting rod is rotatably connected to the cover;

wherein a torsional spring is arranged on the rotating rod, and the torsional spring bears against an inner wall of the housing;

wherein the housing is provided with an installation seat, and the installation seat is provided with a first concave hole, the first connecting rod is provided with a first convex, and the first convex is embedded into the first concave hole and rotates in the first concave hole, the first convex is in clearance fit with the first concave hole.

2. The cover turning mechanism of claim 1, wherein a first rotating shaft is provided at one end of the second connecting rod, the first connecting rod is provided with a first perforation, the first rotating shaft is inserted into the first perforation, and the first rotating shaft is in interference fit with the first perforation.

3. The cover turning mechanism of claim 2, wherein a second perforation is provided at a bottom of the cover, the rotating rod is inserted into the second perforation, and the rotating rod is in interference fit with the second perforation.

4. The cover turning mechanism of claim 3, wherein a clamping block is arranged on the inner wall of the housing and a clamping slot is formed between a lower part of the clamping block and the inner wall of the housing, a hook is arranged at an end of the torsional spring which bears against the inner wall of the housing, the hook is clamped into the clamping slot so that the torsional spring can be clamped with the clamping block.

5. The cover turning mechanism of claim 3, wherein the housing is provided with a platform which bears against the first connecting rod so that the first connecting rod stops swinging.

6. A garbage can, comprising the cover turning mechanism of claim 3.

7. The cover turning mechanism of claim 2, wherein a second rotating shaft is provided at one end of the second connecting rod, a second concave hole is arranged on the cover, the second rotating shaft is inserted into the second concave hole and rotates relative to the second concave hole, and the second rotating shaft is in clearance fit with the second concave hole.

8. The cover turning mechanism of claim 7, wherein a clamping block is arranged on the inner wall of the housing and a clamping slot is formed between a lower part of the clamping block and the inner wall of the housing, a hook is arranged at an end of the torsional spring which bears against the inner wall of the housing, the hook is clamped into the clamping slot so that the torsional spring can be clamped with the clamping block.

9. The cover turning mechanism of claim 7, wherein the housing is provided with a platform which bears against the first connecting rod so that the first connecting rod stops swinging.

10. A garbage can, comprising the cover turning mechanism of claim 7.

11. The cover turning mechanism of claim 2, wherein a clamping block is arranged on the inner wall of the housing and a clamping slot is formed between a lower part of the clamping block and the inner wall of the housing, a hook is arranged at an end of the torsional spring which bears against the inner wall of the housing, the hook is clamped into the clamping slot so that the torsional spring can be clamped with the clamping block.

12. The cover turning mechanism of claim 2, wherein the housing is provided with a platform which bears against the first connecting rod so that the first connecting rod stops swinging.

13. A garbage can, comprising the cover turning mechanism of claim 2.

14. The cover turning mechanism of claim 1, wherein a clamping block is arranged on the inner wall of the housing and a clamping slot is formed between a lower part of the clamping block and the inner wall of the housing, a hook is arranged at an end of the torsional spring which bears against the inner wall of the housing, the hook is clamped into the clamping slot so that the torsional spring can be clamped with the clamping block.

15. The cover turning mechanism of claim 1, wherein the housing is provided with a platform which bears against the first connecting rod so that the first connecting rod stops swinging.

16. A garbage can, comprising the cover turning mechanism of claim 1.

* * * * *